United States Patent [19]

Nuttall

[11] 4,444,361

[45] Apr. 24, 1984

[54] VERTICALLY-ORIENTED, CLOSELY-COUPLED, TWO-DRUM REEL CALENDER

[75] Inventor: David A. Nuttall, Neenah, Wis.

[73] Assignee: Kimberly-Clark Corporation, Neenah, Wis.

[21] Appl. No.: 369,678

[22] Filed: Apr. 19, 1982

[51] Int. Cl.[3] ..... B65H 17/08

[52] U.S. Cl. ..... 242/65; 242/66; 242/67.2

[58] Field of Search ..... 242/65, 66, 67.1, 67.2, 242/75.1; 162/113, 122, 197, 281, 283; 100/168

[56] References Cited

U.S. PATENT DOCUMENTS

| | | | |
|---|---|---|---|
| 2,355,318 | 8/1944 | Moravek | 242/66 |
| 3,291,678 | 12/1966 | Enloe et al. | 162/281 X |
| 3,727,854 | 4/1973 | Grotzbach | 242/66 |
| 4,179,330 | 12/1979 | Page | 242/65 X |

*Primary Examiner*—John Petrakes

*Attorney, Agent, or Firm*—Gregory E. Croft; R. Jonathan Peters; Howard Olevsky

[57] ABSTRACT

An improved means for calendering and winding creped wadding at high speeds comprises two vertically-oriented calender rolls closely coupled with two vertically-oriented reel drums to improve operating efficiency, particularly through ease of threading broken webs.

6 Claims, 2 Drawing Figures

VERTICALLY-ORIENTED, CLOSELY-COUPLED, TWO-DRUM REEL CALENDER

BACKGROUND OF THE INVENTION

In the manufacture of creped wadding, such as facial tissues, the paper webs are would onto a spool (reel spool) at very high speeds. Because many of the lighter weight webs are fragile, it is extremely important that all of the apparatus be properly synchronized so that differences in the rotational speeds of various rolls and drums do not cause breakage of the web. For this reason, many prior processes did not include the step of calendering prior to winding the web on the soft roll. Instead, the web was calendered in the preparation of the hard rolls, where the speed of the web could be more easily controlled without coordinating with the front end of the papermaking process. In general, any added process steps, such as calendering, will decrease overall efficiency of the process.

One of the difficulties caused by the calendering step is the formation of a "bubble" at the exit of the calender nip. This bubble results from compaction of the creped web, which causes the crepe to flatten out to a certain degree, essentially making the web longer in the machine direction. This condition translates into higher web speeds after the calender rolls for which compensation must be made at the wind-up operation. In addition, this condition causes the web to flutter when there is a substantial open draw between the calender nip and the reel spool, which also is an undesirable situation.

Nevertheless, calendering prior to the soft roll is not a novel concept. For example, it is known to calender the web prior to being wound onto a reel spool driven by a single reel drum. This method is illustrated by U.S. Pat. No. 4,179,330 to Page, which teaches the use of two horizontally-oriented calender rolls, one of which forms a nip with the single reel drum. However, this configuration is known to require a more difficult threading operation which can decrease overall operating efficiency.

SUMMARY OF THE INVENTION

In one aspect, the invention resides in an improved process for manufacturing creped wadding comprising: (a) calendering a creped web between a pair of independently driven, vertically-oriented calender rolls, preferably at least one of which is retractable to facilitate threading; and (b) winding the web onto a reel spool driven by a pair of independently driven vertically-oriented reel drums such that the web passes between the two reel drums prior to being wound onto the reel spool, wherein said calender rolls are closely coupled to the reel drums. For purposes herein, the term "closely coupled" shall mean that the calender rolls and the reel drums are positioned sufficiently close together to avoid flutter of the web and thread tails as a single unit, without forming a nip between a calender roll and a reel drum. Precise distances will vary with the speed of the web and its physical characteristics, but in general the calender rolls must be within about 4 feet of the reel drums, and preferably about 2 feet or less as measured by the shortest distance between the outer surfaces of the calender roll and the reel drum which are the nearest to each other. As a practical matter, this distance will, to a large extent, be dictated by spatial considerations of the support framework.

An advantage of having the reel and calender closely coupled is that they thread as a single unit rather than as two separate pieces of equipment. The close coupling also reduces the draw (differential speed) between the reel and the calender. It has been found that the overall efficiency of the production of soft rolls has been minimally affected with the addition of the in-line calendering step of this design. On the other hand, however, the product is of higher quality due to the smoothness imparted by the calendering step. It also improves the uniformity of cross-machine sheet thickness, which in turn improves the quality of the soft roll and improves converting efficiency.

In another aspect, the invention resides in an improved method of threading creped webs onto a reel spool at high speed comprising: (a) threading the tail of a creped web between two independently driven vertically-oriented calender rolls, at least one of which is in a retracted position; (b) thereafter threading the tail of the creped web between two rotating, independently driven, vertically-oriented reel drums, closely coupled with the calender rolls, such that the web passes between one of said reel drums and the reel spool; (c) pressing the web to the reel spool with forced air causing frictional engagement of the web by the spool; (d) winding the web onto the reel spool; and (e) closing the nip between the calender rolls, wherein the tail passes through the calender rolls to the reel spool without interruption.

In a further aspect, the invention resides in an apparatus for calendering and winding a paper web comprising: (a) a pair of vertically-oriented, independently driven calender rolls positioned to form a nip for compressing a paper web passing therebetween, at least one of said calender rolls being retractable to open the nip in order to facilitate threading of the web during start-up; (b) a reel spool for winding the paper web, said reel spool being displaceable in the generally horizontal direction away from the calender rolls; and (c) a pair of independently driven vertically-oriented reel drums closely coupled with said calender rolls and positioned to rotatably drive said reel spool, wherein during operation a paper web can be calendered and would onto successive reel spools at high speed with improved efficiency.

These and other aspects of the invention will be described in greater detail by reference to the Drawing.

DETAILED DESCRIPTION OF THE DRAWING

Figure 1:
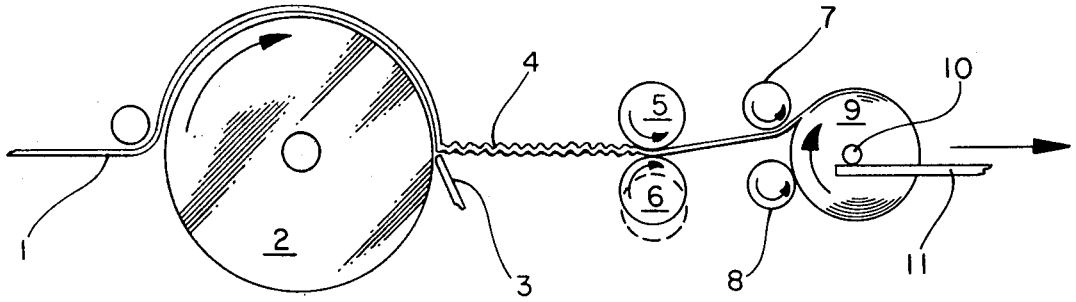
FIG. 1 is a schematic illustration of the apparatus of this invention during operation.

Directing attention to FIG. 1 of the Drawing, the invention will be described in greater detail. A paper web 1 is formed by any suitable means well known in the papermaking arts. This web is adhered to the surface of a creping cylinder 2, which is commonly a Yankee dryer. The web is dislodged from the surface of the creping cylinder by contact with the creping blade 3 causing the web to buckle and thereby forming a creped web 4.

The creped web is then passed through a nip formed between a pair of independently driven, vertically-oriented calender rolls 5 and 6, preferably at least one of which is retractable to facilitate threading tails of light basis weight webs during start-up. (The retracted position of calender roll 6 is indicated by the dashed line). Heavy basis weight webs, which are generally produced at slower speeds, may not need an opened nip for threading. Light basis weights, however, such as those used for facial tissues, would likely be torn up by a closed nip and require a retractable calender roll for threading. The fact that each roll is independently driven is necessary to avoid shearing of the web when the nip is closed after threading. Each calender roll is therefore independently driven by a D.C. drive motor and monitored and controlled so that each calender roll is operating at the same speed as the other. From a product quality standpoint, the calender rolls serve to flatten out the crepe folds in the web and impart a smoother feel to the creped web. Preferably, because temperature control is an important consideration for any calendering operation, both rolls can be designed with built in temperature control. The upper roll can be a temperature compensated roll in which hot water is circulated to control surface temperature. The lower roll can be a variable crown roll, which is also temperature controlled, but which also permits adjustment of the nip between the rolls.

After calendering, the web is directed between two vertically-oriented reel drums 7 and 8 and wound onto the solft roll 9. The vertically-oriented reel drums, are also independently driven. The top drum, which is first to contact the incoming web, generally provides about 40 percent of the torque to the soft roll, whereas the bottom drum provides about 60 percent of the torque. Although the two drums operate at about the same speed, the existence of such differential torque has been found advantageous in producing a suitable soft roll. The reel 10 about which the soft roll is built rests on a generally horizontal rail 11 which aids in removing the soft roll when it has reached a predetermined size. As the completed soft roll is removed the web is broken as a new reel is inserted. The tail of the broken web is immediately pressed against the new reel spool by a blast of forced air, thereby frictionally engaging the web with the new reel spool. The new reel spool, which is rotationally driven by the reel drums, forms the core for a new soft roll. Although the means for removing the soft roll and inserting a new reel does not form a part of this invention, it is further described in copending application Ser. No. 278,736 filed June 29, 1981, which is hereby incorporated by reference.

Figure 2:
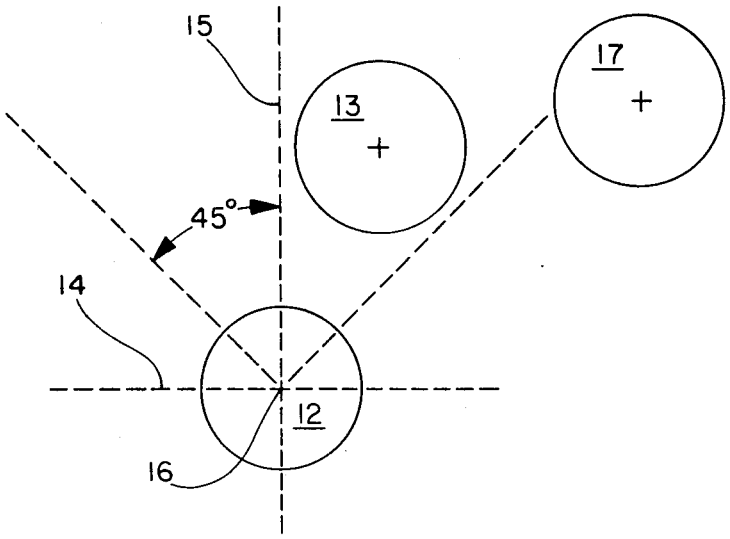
FIG. 2 is an illustration of the term "vertically-oriented".

For purposes herein, the term "vertically-oriented" as it relates to the position of the calender rolls shall mean that the calender rolls are positioned such that the rotational axis of the upper roll is within 45° of a vertical line drawn through the rotational axis of the lower roll as indicated in FIG. 2. Shown in FIG. 2 are hypothetical rolls arbitrarily spaced apart to illustrate the point (In practice the rolls would normally be touching, although not necessarily.). In particular, shown are a lower roll 12 and upper rolls 13 and 17. Horizontal line 14 and vertical line 15 are drawn through the rotational axis 16 of the lower roll. As indicated in FIG. 2, roll 13 is vertically-oriented with roll 12 since its rotational axis falls within 45° of the vertical line 15. On the other hand, roll or drum 17 is not vertically-oriented because its rotational axis lies outside 45° from the vertical. Advantageously, however, the upper roll is at least within 20° of absolute vertical and more preferably within about 10° vertical because threading becomes progressively more difficult as the open "window" is narrowed by configurations having a more horizontal alignment. In practice, the upper calender roll is couched over slightly an amount sufficient to prevent one roll from being skewed relative to the other.

The term "vertically-oriented", as it relates to the reel drums, is more restrictive since the reel drums must always remain in contact with the soft roll as the soft roll increases in diameter and slowly travel along the horizontal rails as previously mentioned. Therefore the reel drums are positioned as close to absolute vertical as is practical so as to enable the reel drums to continuously engage the soft roll.

The term "independently" as used herein means that the calender rolls or reel drums in question are not caused to rotate by frictional engagement with the other roll or drum, but rather by a source of power suitably connected to the rotational axis of each roll or drum.

As can be seen from FIG. 1, the web preferably has a direct and unobstructed path to the soft roll from the calender rolls. The distance between the calender rolls and the reel drums is preferably as short as is physically possible within structural limitations. This configuration, having the vertically-oriented calender rolls closely coupled with vertically-oriented reel drums, provides reduced flutter, less stretching of the sheet due to a short open draw, and permits easy threading of the web as a single unit during start-up operations as opposed to the more difficult process of threading the calender rolls and the reel in distinct, separate steps. This construction is believed to avoid a loss in overall operating efficiency, which would be expected to accompany the inclusion of an in-line calendering step, because of its simplicity and reliability in threading operations. At the same time, smoothness of the product is increased and improved soft rolls are obtained.

It will be appreciated by those skilled in the papermaking arts that the foregoing embodiment, shown only for purposes of illustration, is not to be construed as limiting the scope of this invention, which is defined by the following claims.

I claim:

1. In a process for manufacturing creped wadding wherein a creped web is dislodged from a creping cylinder and wound onto a reel spool, the improvement comprising:

(a) calendering the creped web directly after leaving the creping cylinder between a single pair of vertically-oriented, independently driven calender rolls; and (b) winding the calendered web onto a reel spool driven by a pair of independently driven, vertically-oriented reel drums which are closely coupled with said calender rolls, such that the web passes between the two reel drums prior to being wound onto the reel spool.

2. The process of claim 1 wherein the vertically-oriented calender rolls are positioned from each other within about 20° of absolute vertical.

3. The process of claim 1 wherein the vertically-oriented calender rolls are positioned from each other within about 10° of absolute vertical.

4. The process of claim 1 wherein the vertically-oriented reel drums are within about 2 feet of the vertically-oriented calender rolls.

5. The process of claim 1 wherein the calender rolls are relatively positioned away from absolute vertical an amount sufficient to prevent skewing of one roll relative to the other.

6. In a process for manufacturing creped wadding wherein a creped web is dislodged from a creping cylinder and wound onto a rotating reel spool, the improvement comprising:

(a) threading the tail of the creped web between two independently driven, vertically-oriented calender rolls, at least one of which is in a retracted position;

(b) thereafter threading the tail of the creped web between two independently driven, vertically-oriented reel drums, closely coupled with the calender rolls, such that the web passes between one of said reel drums and the reel spool;

(c) pressing the web to the reel spool with forced air causing frictional engagement of the web by the spool;

(d) winding the web onto the reel spool; and (e) closing the nip between the calender rolls, wherein the tail passes through the calender rolls to the reel spool without interruption.

* * * * *